US006027174A

United States Patent [19]

Gerbasi

[11] Patent Number: 6,027,174

[45] Date of Patent: Feb. 22, 2000

[54] METHOD AND APPARATUS FOR REMOVING CERAMIC TILE

[75] Inventor: John C. Gerbasi, 7805 Ridgefield Rd., Parma, Ohio 44129

[73] Assignee: John C. Gerbasi, Parma, Ohio

[21] Appl. No.: 09/013,339

[22] Filed: Jan. 26, 1998

[51] Int. Cl.[7] ..... E21C 37/16

[52] U.S. Cl. ..... 299/14; 299/36.1; 404/77; 404/95

[58] Field of Search ..... 299/14, 36.1; 404/77, 404/79, 95

[56] References Cited

U.S. PATENT DOCUMENTS

| | | | |
|---|---|---|---|
| 3,400,244 | 9/1968 | Meltzer | 219/228 |
| 3,601,448 | 8/1971 | Stone | 299/14 |
| 4,981,548 | 1/1991 | Poll | 156/584 |
| 5,082,330 | 1/1992 | Holder | 299/37.1 |
| 5,197,784 | 3/1993 | Holder | 299/37.1 |

FOREIGN PATENT DOCUMENTS 759278 10/1996 United Kingdom .

*Primary Examiner*—Eileen Dunn Lillis
*Assistant Examiner*—John Kreck
*Attorney, Agent, or Firm*—Calfee, Halter & Griswold LLP

[57] ABSTRACT

A method of removing ceramic tile wherein the tiles are heated using a gas burner by passing the flame of the burner over the surface of the ceramic tile where it is secured to a supporting surface by grout or other cementitious material. The ceramic tile is thus exposed to the burner flame for a period of time sufficient to fracture the ceramic tile from its secured position surrounded by the grout or other cementitious material. The apparatus upon which the burner is mounted includes a fuel supply, a burner assembly having at least one gas burner with a flame of at least 200,000 BTU. The fuel supply and burner assembly are interconnected to supply fuel to the burner assembly, and are mounted on a wheeled cart. The burner assembly is further positioned on the cart such that the burner is at least 3–5 inches above the ceramic tile being removed, such that the flame is provided from the burner in a circle having a diameter of approximately 6 inches over the ceramic tile being removed.

18 Claims, 5 Drawing Sheets

METHOD AND APPARATUS FOR REMOVING CERAMIC TILE

TECHNICAL FIELD

The present invention relates to a method and apparatus for removing ceramic tile, and more particularly to a method and apparatus for removing ceramic tile by fracturing using thermal shock.

BACKGROUND OF THE INVENTION

In the past, the removal of ceramic tile, such as floor tile, in large areas has been a difficult and expensive construction process. Ceramic, as used throughout this application, shall include, for example, structural clay products, such as brick, tile, terra cotta, or glazed architectural brick; "whitewares," such as porcelain or floor tile. Such tile is generally secured to the adjacent supporting structure, whether floor or walls, in a desired geometric pattern using grout. Underneath the tiles and grout, concrete is typically used as a support material. The grout may be cement or other cementitious materials including cement, polymer material or other composites. The tile is generally well secured to the concrete or supporting structure, such that jack hammers, hammers, shovels and other tools are required for its removal. Such tools are used to fracture the tiles as well as the grout surrounding the tiles, in order to permit their removal. Once the materials are fractured, collecting and removing the broken tiles and grout is a simple process.

Particularly in commercial buildings where large expanses of floor tile must be removed, the process is typically very labor intensive. Many man hours, days or even weeks may be required to remove tile from areas as large as a retail mall or office building. Numerous individuals may be required to operate several jack hammers, so the rubble may be readily removed. Such labor is expensive, and its cost increases rapidly where the process is very time consuming.

Additional disadvantages of this prior process include the creation of large amounts of dust, as well as noise. Since tile removal is often taking place in a building that is being remodeled, such buildings may also be currently occupied. The creation of dust within the building may be of great concern to the building occupants. The occupants may be operating retail stores containing valuable merchandise and attempting to provide consumers with a pleasant atmosphere, or they may be operating businesses involving paperwork and associated office equipment. In either environment, dust and dirt are undesirable consequences which, if not addressed, may result in damage to merchandise and equipment.

SUMMARY OF THE INVENTION

The present invention provides a new and improved method and apparatus for removing ceramic tile. During operation of the present apparatus, heat is applied to the tiles resulting in their fracture due to expansion and thermal shock. The invention reduces the amount of time and labor required to remove large areas of ceramic tile, thereby reducing labor costs. For example, removing approximately 500 square feet of ceramic tile using prior techniques could be accomplished by 6 men during a shift. While the present invention enables the removal of approximately 2,500 square feet of ceramic tile using only 3 men during a shift. Obviously, a great deal more of ceramic tile is removed using the present invention, while using less labor than previously required. Further, the present invention fractures ceramic tile from its surrounding grout without the generation of significant dust.

According to the present invention, ceramic tile is removed by applying heat over the surface of the tile using a propane burner. The tile experiences thermal expansion and cracks against the rigid composite material or grout immediately surrounding it and/or the rigid cement supporting it. The present method and apparatus may also be successfully used to remove ceramic tile supported on suspended beams, since the heat is only applied to the tiles, and no impact is believed to be made on any of the underlying structural supports or materials.

The apparatus of the present invention includes a wheeled metal cart which supports a burner assembly and a fuel supply, such as a propane tank. The cart includes a handle, so that it may be guided by an operator over the surface of the ceramic tile being removed.

Other features and advantages of the present invention will become apparent from the following detailed description of the preferred embodiment made with reference to the accompanying drawings, which form a part of the specification.

DETAILED DESCRIPTION OF THE PREFERRED EMBODIMENT

Figure 1:
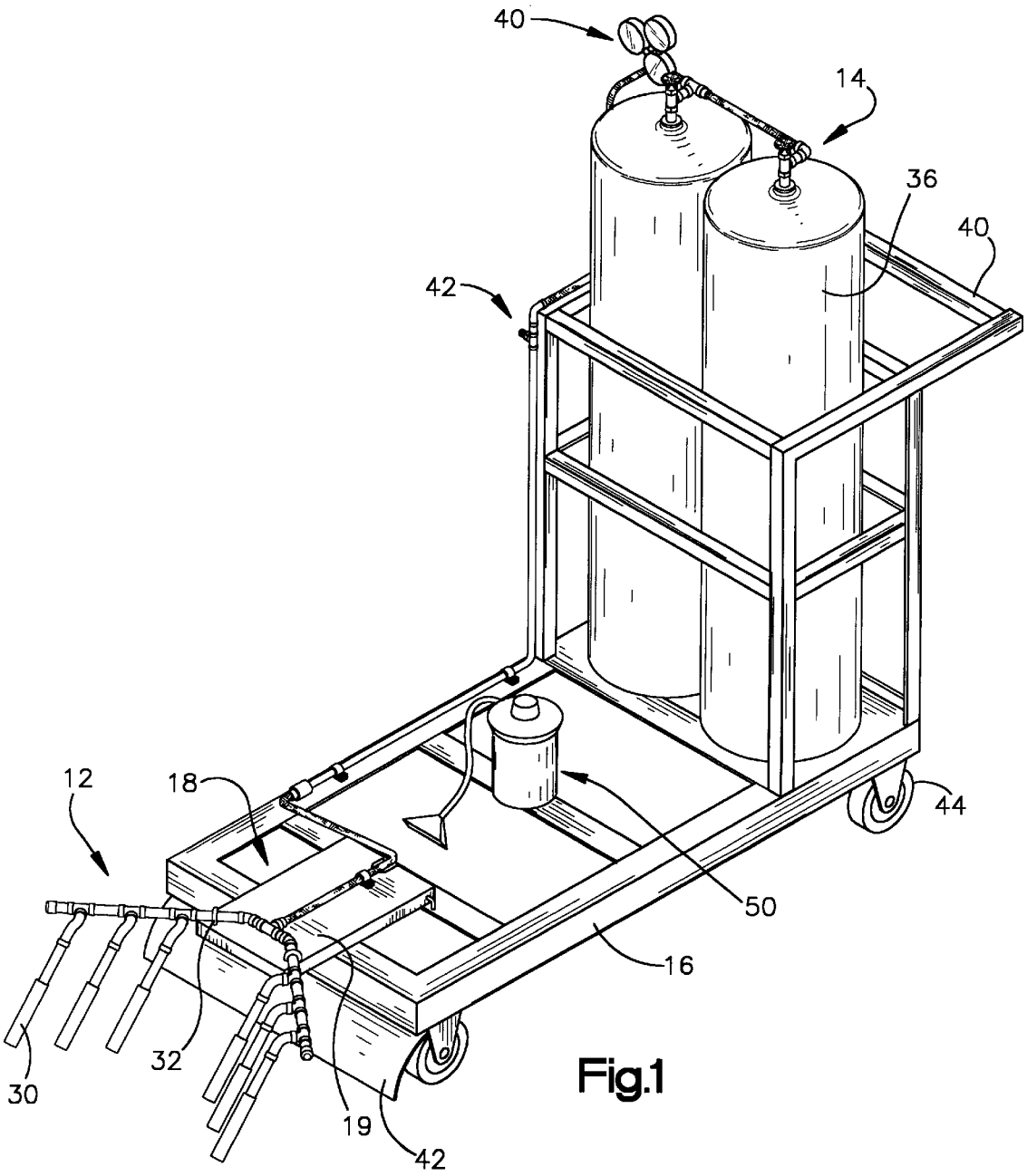
FIG. 1 is a perspective view of the apparatus for removing ceramic tile in accordance with the present application.

The apparatus of the present invention for removing ceramic tile is illustrated in FIGS. 1–5 at reference numeral 10. The apparatus includes a burner assembly 12 interconnected with a fuel supply 14. The burner assembly 12 and fuel supply 14 are supported on a wheeled metal cart 16. During operation of the apparatus, the cart 16 is moved over the ceramic tiles to be removed, such that the flames from the burner assembly are positioned directly over the tiles. Movement of the cart is timed to sufficiently heat the tiles until they fracture. No additional tools are required to crack or otherwise break the tiles.

Figure 3:
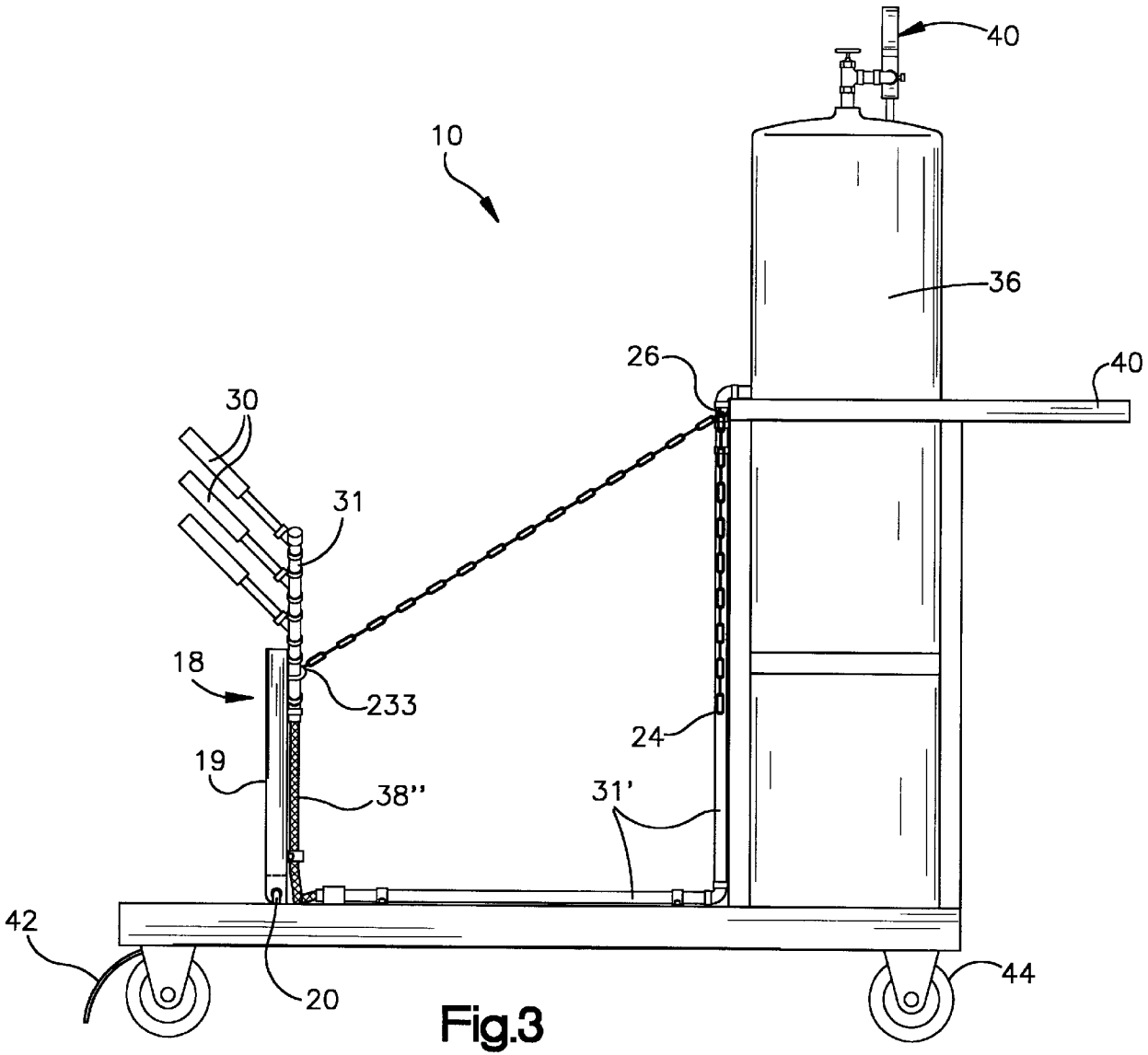
FIG. 3 is side view of the apparatus of the present application with the burner assembly shown in elevated position.
Figure 4:
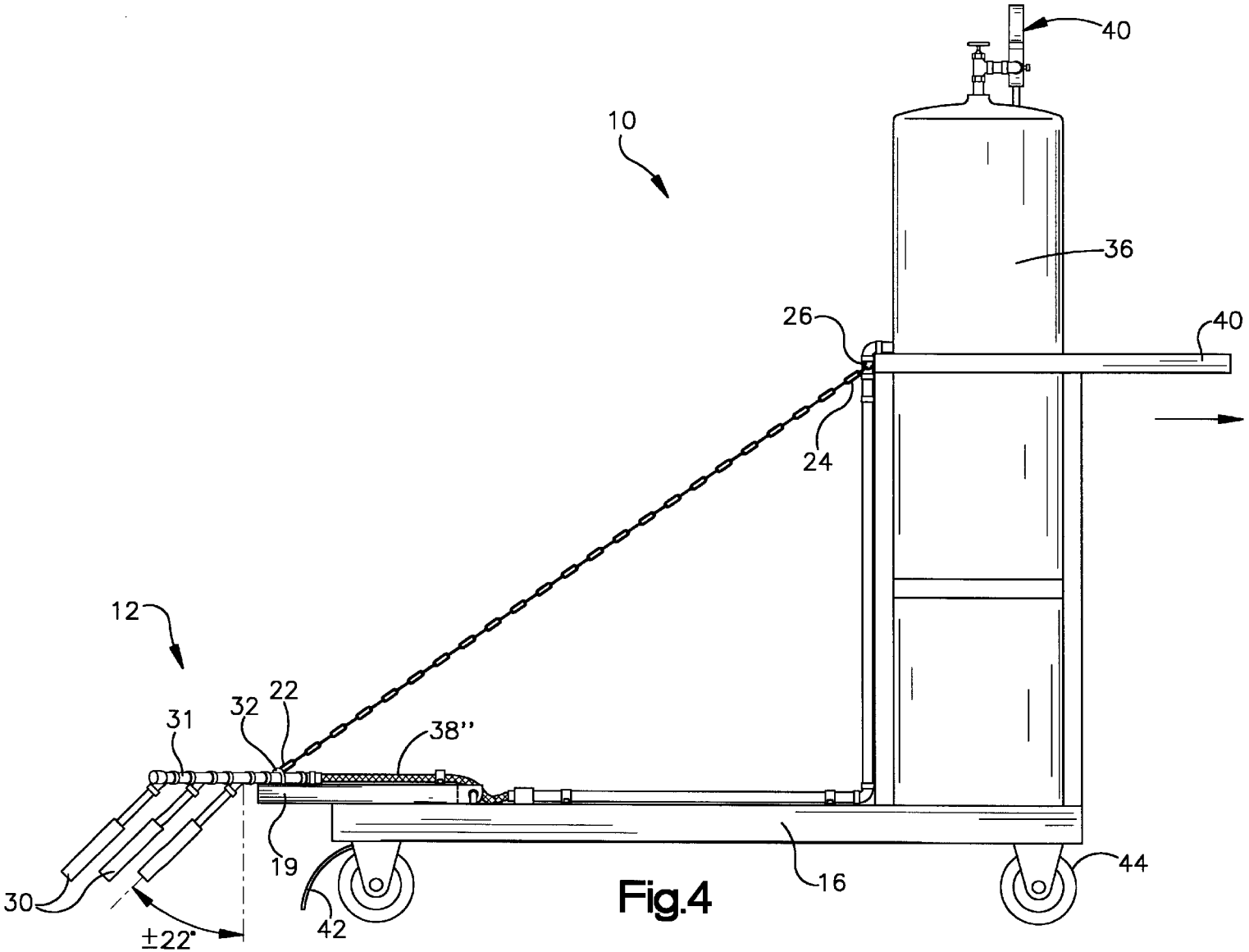
FIG. 4 is a side view of the apparatus of the present application with the burner assembly shown in operating position.
Figure 5:
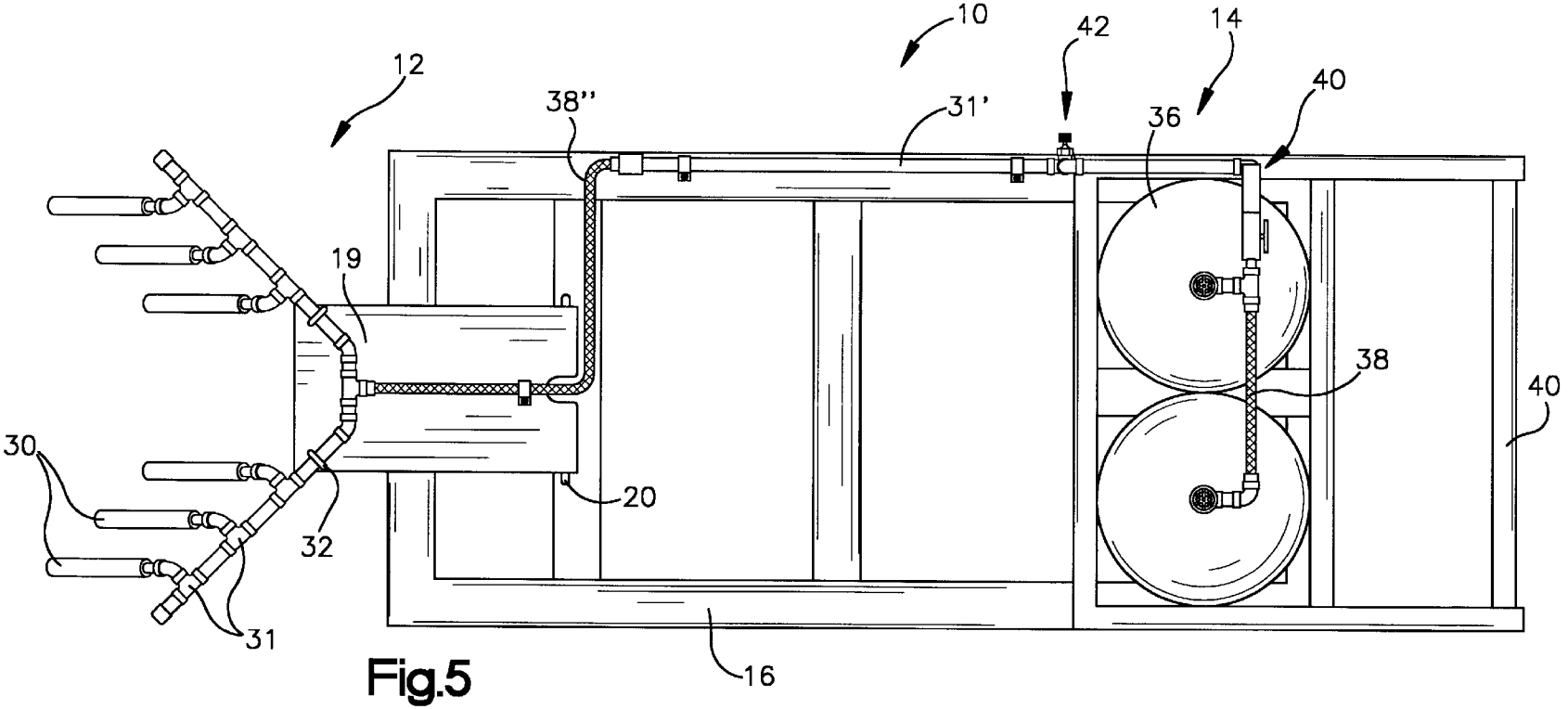
FIG. 5 is a top plan view of the apparatus of FIG. 4.

The burner assembly 12 is mounted on a movable mounting assembly 18. The mounting assembly 18 includes a mounting plate 19 and a shaft 20. The mounting plate 19 is secured to the shaft 20. The shaft 20 is engaged with the cart by conventional means such as welding, so that the mounting plate 19 may be pivoted upon the shaft as illustrated in FIG. 3. A chain 22 is secured on one end 23 to the mounting plate, also by conventional means such as a hook, and on the other end 24 to a hook 26 secured to the cart 16. As shown in FIG. 4, the chain 22 is in a fully extended condition, with the burner assembly 12 located near the floor in an operating position. In this operating position, the mounting plate 19 rests on the cart 16. When the chain 24 is secured to the hook 26 along a link located intermediate the ends 23, 24, the burner assembly 12 is positioned in an elevated position as shown in FIG. 3.

The burner assembly 12 includes at least one burner head 30. The illustrated burner heads are conventional "weed burners," and may be of the type which operate at at least 200,000 BTU or up to as high as 400,000 BTU. Although higher energy heads may be used, higher heat is not believed required for successful operation of the apparatus 10. In the illustrations of FIGS. 1–5, six burner heads 30 are positioned in a v-shaped configuration. However, it should be understood that the burner heads 30 may be positioned in any other appropriate configuration to match the construction application, such as curved, L-shaped or straight.

Figure 6:
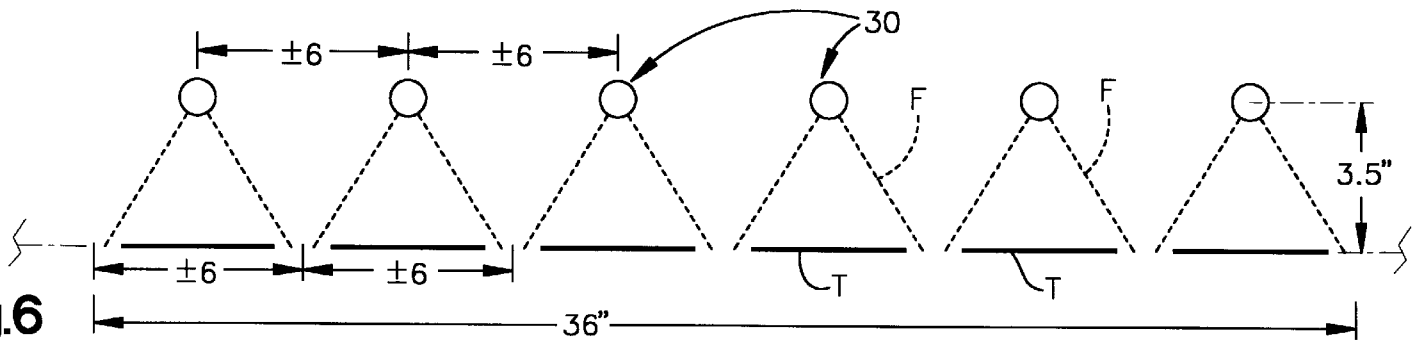
FIG. 6 is a schematic diagram showing the spacing of the burner assembly with respect to the ceramic tiles being removed.

The preferred spacing of the heads 30 is as shown in FIG. 6, with approximately 6 inches between each of the heads. Additionally, the burner heads 30 are mounted on the mounting plate in the operating position such that they are approximately 3–5 inches from the ceramic tiles to be removed. In this position, the flame F from each head 30 provides a circle of flame which is approximately 6 inches in diameter on the ceramic tile. As shown in FIG. 6, this results in a substantially continuous flame from the lighted burner heads 30 across a series of ceramic tiles T for about 36 inches. Where the ceramic tiles are of the size indicated, each tile may be directly under a flame. However, where the tiles are closer together or smaller in size, multiple tiles may receive the flame of one burner head. It is believed that the use of multiple burner heads 30 spaced substantially as described results in the efficient creation of thermal shock over numerous tiles. A larger number of burner heads could certainly be used.

The burner heads 30 are preferably angled away from the cart 16. The angular direction is desired to support and take advantage of the burner head logic, including air flow and the positive pressure arrangement. An angle of approximately 22° as illustrated in FIG. 4, is believed to take advantage of the burner logic and provides a blanket of flames which sufficiently heats the tiles such that they thermally expand, and consequently break away from their supporting and surrounding substrate, which is the underlying thinset material and surrounding grout. For example, use of the present apparatus over a 36 inch width may result in expansion of the ceramic tile as much as 6 inches from the floor. In some cases the tile itself fractures, in other instances only the surrounding material breaks and the tile is left intact. It is not the intent of the present invention to save for reuse any of the ceramic tile being removed.

Figure 2:
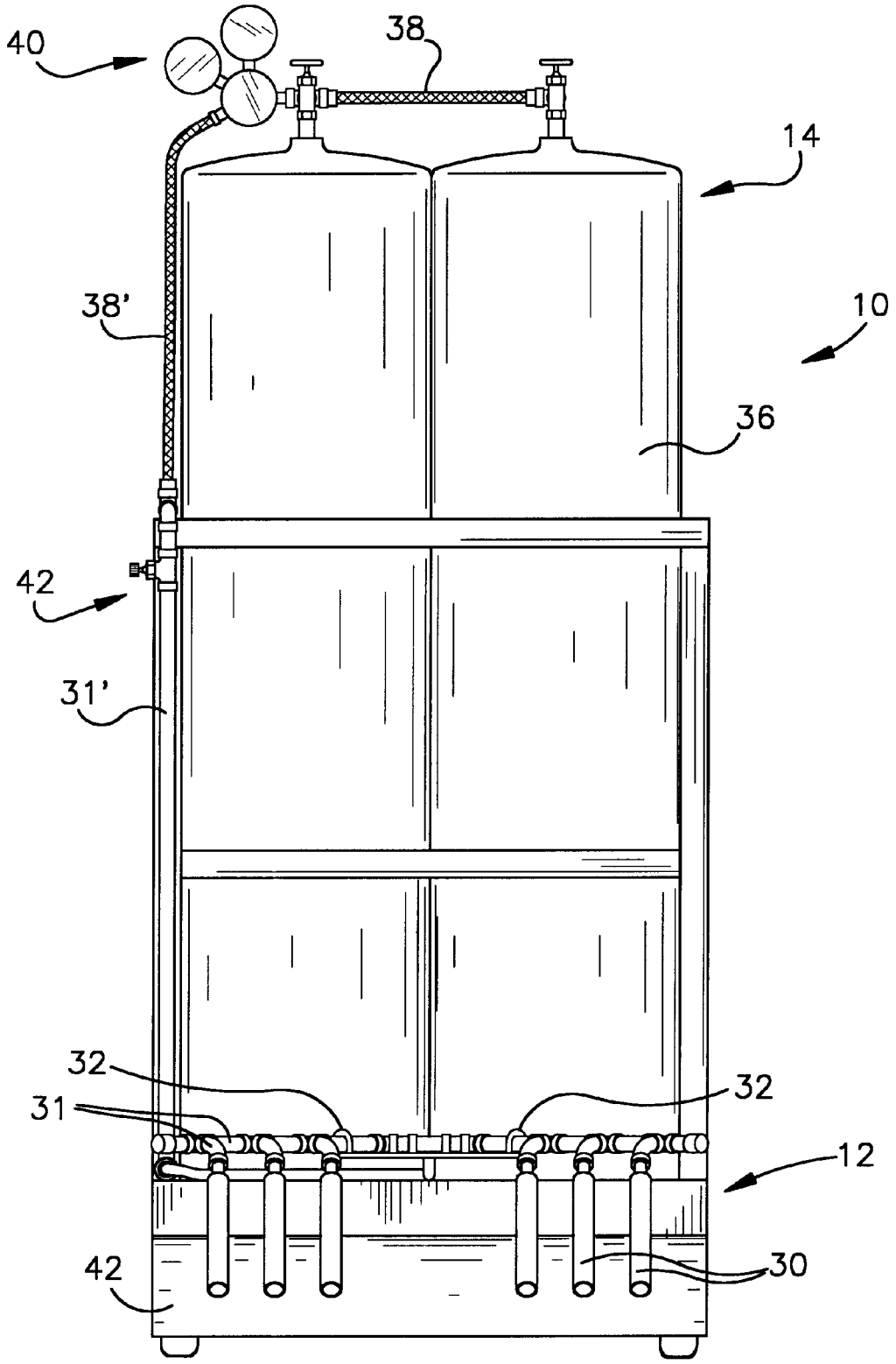
FIG. 2 is a front view of the apparatus of FIG. 1.

The burner heads 30 are interconnected with each other via conventional malleable or black iron pipe 31, and are also interconnected with the fuel supply 14. As best illustrated in FIGS. 2 and 4, the interconnected burner heads 30 are secured to the mounting plate 19 by conventional brackets 32. As also shown, the fuel supply 14 is propane gas which is provided in the form of two 100 pound tanks 36, 36'. The tanks 36, 36' are interconnected in series by conventional flexible conduit 38 suitable for supplying propane gas. Additional combinations of flexible conduit 38', 38" and pipe 311 are used to interconnect the propane gas tanks 36, 36' with the burner heads 30.

Intermediate the tanks 36 and the burner heads 30 pressure gauges 40 and a regulator 42 are provided. The gauges are provided to confirm the gas pressure within the tanks and along the pipe 38 and conduit 31 within the apparatus. The regulator 42 is a conventional dial control device, which enables the operator of the apparatus to increase and decrease the gas flow from the tanks to obtain the optimum burn in the flames of the burner heads 30. It is desired to obtain an efficient burn, which is preferably accomplished by the operator adjustment of the flame until a mostly blue flame is visible.

The cart 16 which supports the burner assembly 12 and the fuel supply 14 is a conventional wheeled cart. It is believed that a metal cart is desirable to avoid damage to the cart during high heat operation. As shown, the propane tanks 36, 36' are removably supported and preferably enclosed within the frame of the cart. Additionally, a handle 40 is provided for use during operation of the apparatus. Still further, a wheel protector or "splash guard" 42 is provided to prevent the heat and fractured ceramic tiles near the burner assembly from interfering with the wheels adjacent the burner assembly 12. It is noted that the apparatus 10 is operated in the direction indicated by the arrow in FIG. 4. The operator pulls the cart 16 over the adhered ceramic tile for good drivability. Additional control is obtained for turning using the swiveling wheels or casters 44, located under the cart handle 40. The cart wheels adjacent the splash guard 42 are fixed.

Once the ceramic tiles to be removed have been fractured under the heat applied by the apparatus 10, together with the expansion of the tiles against the grout surrounding them or the other rigid material supporting them, the rubble may be readily swept or shoveled away.

It is additionally understood that a fire prevention device 50, as shown in FIG. 1, may be supported on the cart 16 to extinguish any unwanted combustion.

The preferred form of the apparatus for removing ceramic tile and the method of operation have been described above. However, with the present disclosure in mind it is believed that obvious alterations to the preferred embodiment, to achieve comparable features and advantages in other assemblies, will become apparent to those of ordinary skill in the art.

I claim:

1. A method of removing ceramic tile comprising the steps of:

passing a burner having a flame of at least 200,000 BTU over the surface of the ceramic tile which is secured to a supporting surface by cementitious material;

exposing the ceramic tile to said burner for a period of time sufficient to fracture the ceramic tile from its position surrounded by cementitious material; and expanding the ceramic tile such that it is no longer secured within cementitious material.

2. A method of removing ceramic tile from a position secured within cementitious material comprising the steps of:

lighting a gas burner;

passing said gas burner over the surface of the ceramic tile;

exposing the gas burner to the ceramic tile for a time sufficient to thermally expand the ceramic tile to dislodge the ceramic tile from its surrounding support material; and removing the pieces of ceramic tile and cementitious material.

3. The method of claims 1 or 2 wherein said cementitious material is grout.

4. The method of claim 2 wherein said gas burner has a flame of at least 200,000 BTU.

5. The method of claim 4 wherein at least two gas burners are passed over the surface of the ceramic tile.

6. The method of claim 4 wherein at least four gas burners are passed over the surface of the ceramic tile.

7. The method of claim 4 wherein at least six gas burners are passed over the surface of the ceramic tile.

8. The method of claim 7 wherein said gas burners are supplied with propane gas.

9. The method of claim 8 wherein each of said gas burners has a flame of at least 400,000 BTU.

10. The method of claims 4, or 9 wherein said gas burners are spaced approximately 3–5 inches from the surface of the ceramic tile.

11. The method of claim 10 wherein said flames from each of said gas burners form a circle of approximately 6 inches in diameter.

12. An apparatus for removing ceramic tile by fracturing the tile under thermal shock, the apparatus comprising;

a fuel supply;

a burner assembly having at least one gas burner with a flame of at least 200,000 BTU;

said fuel supply and burner assembly being interconnected to supply fuel to said burner assembly and being mounted on a wheeled cart;

said burner assembly being positioned on said cart such that said burner is at least 3–5 inches above the ceramic tile to be removed, and said flame is provided from said burner in a circle having a diameter of approximately 6 inches on said ceramic tile to be removed.

13. The apparatus of claim 12, wherein said burner assembly includes six gas burners.

14. The apparatus of claim 13, wherein said gas burners each have a flame of at least 400,000 BTU.

15. The apparatus of claim 14, wherein said fuel supply comprises two propane tanks of approximately 100 pounds each, and said tanks are connected in series to supply propane to said gas burners.

16. The apparatus of claim 14, wherein said wheeled cart includes a wheel protection guard mounted to prevent pieces of ceramic tile from interfering with the movement of the cart during operation.

17. The apparatus of claim 14, wherein said burner assembly is secured to a movable mounting assembly secured to said cart, such that the burner assembly may be positioned on said mounting assembly in an operating position during operation of the device or moved to an elevated position on said mounting assembly to prevent damage to said burners during non-operating transport of the apparatus.

18. The apparatus of claim 17, wherein said apparatus includes a fire extinguisher mounted on said cart.

* * * * *